US008306455B2

(12) United States Patent
Tokunaga et al.

(10) Patent No.: US 8,306,455 B2
(45) Date of Patent: Nov. 6, 2012

(54) TRANSFER DEVICE AND IMAGE FORMING APPARATUS

(75) Inventors: Masaaki Tokunaga, Ebina (JP); Koichi Sato, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 309 days.

(21) Appl. No.: 12/722,676

(22) Filed: Mar. 12, 2010

(65) Prior Publication Data

US 2011/0069990 A1 Mar. 24, 2011

(30) Foreign Application Priority Data

Sep. 18, 2009 (JP) ..... 2009-216836

(51) Int. Cl.
*G03G 15/08* (2006.01)

(52) U.S. Cl. ..... 399/121; 399/313; 399/318

(58) Field of Classification Search ..... 399/121, 399/313, 318
See application file for complete search history.

(56) References Cited

U.S. PATENT DOCUMENTS

| | | | | |
|---|---|---|---|---|
| 3,751,156 | A * | 8/1973 | Szostak et al. | 399/101 |
| 5,440,379 | A * | 8/1995 | Hayamizu | 399/308 |
| 6,862,421 | B2 * | 3/2005 | Choi | 399/302 |
| 7,899,381 | B2 * | 3/2011 | Chiba et al. | 399/345 |
| 8,059,980 | B2 * | 11/2011 | Okamoto | 399/66 |
| 2002/0106224 | A1 | 8/2002 | Yamauchi et al. | |
| 2003/0128999 | A1 * | 7/2003 | Bessho et al. | 399/121 |
| 2004/0013452 | A1 * | 1/2004 | Choi | 399/313 |
| 2005/0019068 | A1 | 1/2005 | Yamauchi et al. | |
| 2005/0276637 | A1 * | 12/2005 | Koike et al. | 399/313 |
| 2006/0062593 | A1 * | 3/2006 | Takahashi | 399/121 |
| 2006/0072929 | A1 * | 4/2006 | Takahashi | 399/13 |
| 2007/0212108 | A1 * | 9/2007 | Hozono et al. | 399/121 |
| 2009/0022514 | A1 * | 1/2009 | Fujiwara et al. | 399/121 |
| 2011/0110685 | A1 * | 5/2011 | Sato et al. | 399/121 |
| 2011/0280602 | A1 * | 11/2011 | Takenaka | 399/45 |

FOREIGN PATENT DOCUMENTS

| | | | |
|---|---|---|---|
| JP | 3735045 | B2 | 10/2005 |
| JP | 3925606 | B2 | 3/2007 |
| JP | 2007-086267 | A | 4/2007 |

* cited by examiner

*Primary Examiner* — David Gray
*Assistant Examiner* — G. M. Hyder
(74) *Attorney, Agent, or Firm* — Sughrue Mion, PLLC

(57) ABSTRACT

A transfer device includes: a transfer roll that transfers a toner image formed on an image holding body to a transfer subject medium; a first holding member that holds the transfer roll rotatably; a pressure contact member that brings, via the first holding member, the transfer roll into pressure contact with the image holding body; a second holding member that holds the first holding member swingably and movably; and a pressing member that produces a pressing force for bringing the pressure contact member into pressure contact with the first holding member and the second holding member in a state that the first holding member is inclined from the second holding member.

18 Claims, 8 Drawing Sheets

TRANSFER DEVICE AND IMAGE FORMING APPARATUS

CROSS-REFERENCE TO RELATED APPLICATIONS

This application is based on and claims priority under 35 USC 119 from Japanese Patent Application No. 2009-216836 filed on Sep. 18, 2009.

BACKGROUND

Technical Field

The present invention relates to a transfer device and an image forming apparatus.

SUMMARY

According to an aspect of the invention, there is provided a transfer device including a transfer belt for holding a visible image that has been transferred from an image holding body; a transfer roll for transferring the toner image from the image transfer belt to a sheet; a first holding member for holding the transfer roll rotatably; a pressure contact member for bringing, via the first holding member, the transfer roll into pressure contact with the transfer belt; a second holding member for bringing the transfer roll into pressure contact with the transfer belt via the pressure contact member and the first holding member, and for holding the first holding member swingably and movably; and a spring force producing member for producing a spring force for bringing the pressure contact member into pressure contact with the first holding member and the second holding member in a state that the first holding member is inclined from the second holding member.

BRIEF DESCRIPTION OF THE DRAWINGS

Exemplary embodiments of the present invention will be described in detail based on the following figures, wherein:

FIGS. 7A and 7B shows states that a lid member is closed and opened, respectively.

DETAILED DESCRIPTION

Exemplary Embodiment (Overall Configuration of Image Forming Apparatus)

Figure 1:
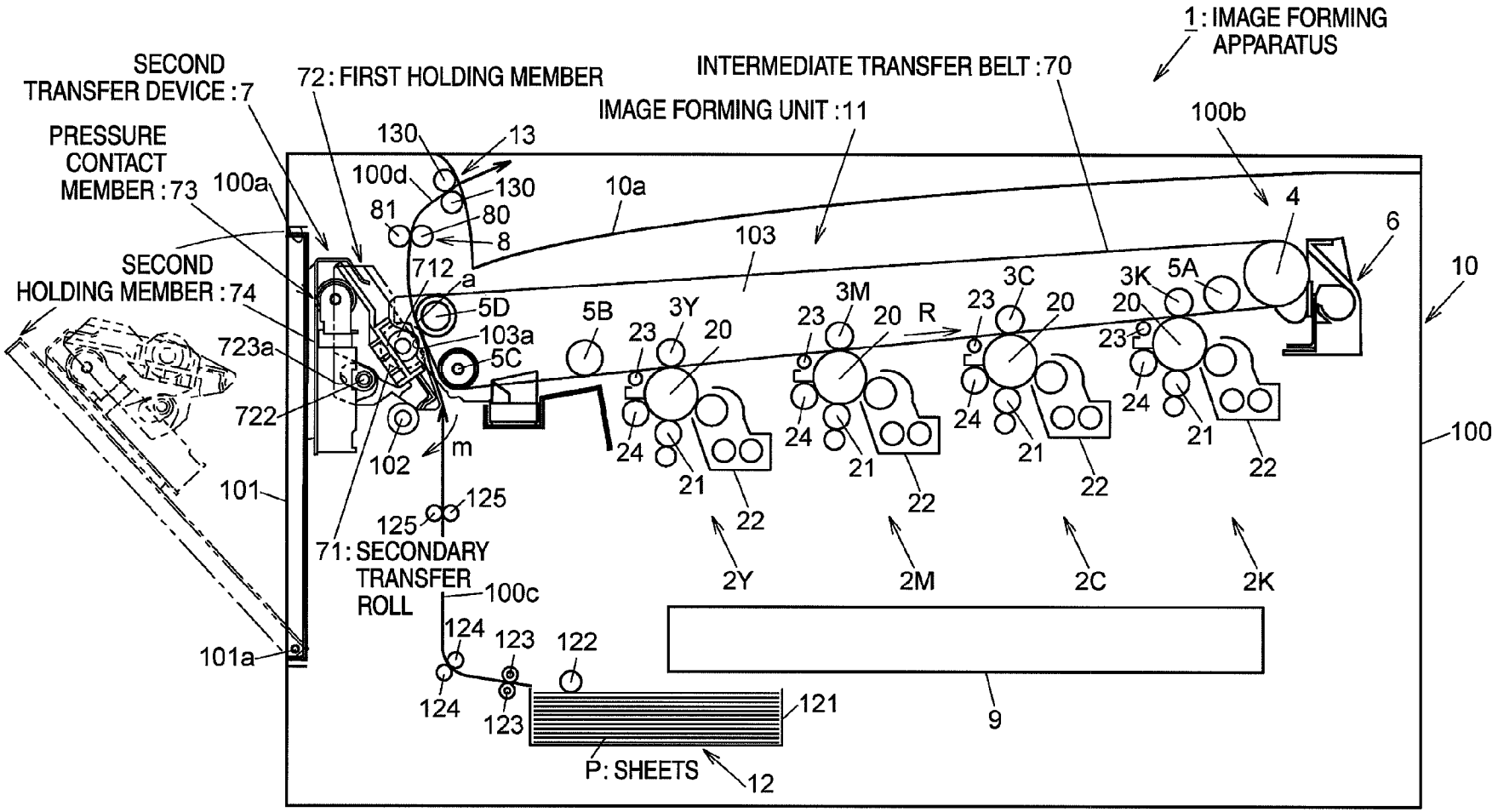
FIG. 1 is a sectional view showing the overall configuration of an image forming apparatus to which a transfer device according to an exemplary embodiment of the present invention is applied.

First, an image forming apparatus according to an exemplary embodiment of the present invention will be described with reference to FIG. 1, which shows the overall configuration of the image forming apparatus. As shown in FIG. 1, the image forming apparatus 1 has an apparatus main body 10 which incorporates an image forming unit 11, a sheet supply unit 12, and a sheet discharge unit 13. The image forming apparatus 1 is a color copier, for example.

(Configuration of Apparatus Main Body 10)

The apparatus main body 10 has a case member 100 having an opening and a lid member 101 for opening or closing the opening 100*a*. An outputted sheet tray 10*a* is disposed above the lid member 101.

An accommodation space 100*b* in which the image forming unit 11, the sheet supply unit 12, the sheet discharge unit 13, etc. are provided, a transporting path 100*c* extending from the sheet supply unit 12 to the image forming unit 11, and a sheet discharge path 100*d* extending from the image forming unit 11 to the sheet discharge unit 13 are formed in the case member 100. A swing restriction member 102 which restricts a swing of a first holding member 72 in one direction (indicated by arrow m) and exerts a pressure contact force $F_2$ (see FIG. 5) in a state that the lid member 101 is closed is disposed in the case member 100. The pressure contact force $F_2$ (about 80 to 90 N) is exerted on the first holding member 72 at position c (see FIG. 5; located on the side of the swing restriction member 102, that is, on the side opposite to the supporting point) with a pressure contact point a (where a pressure contact force acts from a secondary transfer roll 71 to an intermediate transfer roll 70) as a supporting point.

The lid member 101 is attached to the case member 100 in a swingable manner. The lid member 101 is configured so as to be opened and closed in such a manner as to swing about a swing center 101*a* between a closed position (indicated by a solid line in FIG. 1) and an open position (indicated by a two-dot chain line in FIG. 1).

(Configuration of Image Forming Unit 11)

The image forming unit 11 is provided with a first image forming unit 2Y for forming a yellow (Y) toner image, a second image forming unit 2M for forming a magenta (M) toner image, a third image forming unit 2C for forming a cyan (C) toner image, a fourth image forming unit 2K for forming a black toner image, first transfer devices 3Y, 3M, 3C, and 3K which are disposed at primary transfer positions and primarily transfer the yellow, magenta, cyan, and black toner images formed by the image forming units 2Y, 2M, 2C, and 2K to the intermediate transfer belt 70 (corresponds to the term "image holding member" used in the claims), respectively, a drive roll 4 for driving the intermediate transfer belt 70 in the direction indicated by arrow R, support rolls 5A-5D for supporting the intermediate transfer belt 70 so that it can rotate with prescribed tension, a cleaning unit 6 for cleaning the surface of the intermediate transfer belt 70, a second transfer device 7 (described later) having a secondary transfer roll 71 (corresponds to the term "transfer roll" used in the claims) for transferring the toner images from the intermediate transfer belt 70 to a sheet P, a fixing device 8 for fixing the toner images transferred to the sheet P by heat-melting them, and an exposing device 9 for exposing photoreceptor drums 20 to light. The image forming unit 11 is disposed above the sheet supply unit 12 and housed in the accommodation space 100*b*.

Each of the image forming units 2Y, 2M, 2C, and 2K is configured so as to be detachable from the apparatus main body 10. Each of the image forming units 2Y, 2M, 2C, and 2K is provided with the photoreceptor drum 20 having a surface photosensitive layer, a charging device 21 for charging the photoreceptor drum 20 before exposure, a developing device 22 for developing an electrostatic latent image formed on the photoreceptor drum 20 with a toner of the corresponding color, a charge erasing device 23 for erasing charge from the photoreceptor drum 20, and a drum cleaning unit 24 for removing residual toner from the photoreceptor drum 20 after a primary transfer.

The support rolls 5A-5D, which are follower rolls, are attached rotatably to the apparatus main body 10 via an attachment plate 103. Among the support rolls 5A-5D, the support roll 5C functions as a tension roll, the support rolls 5A and 5B function as primary transfer surface forming rolls, and the support roll 5D functions as a backup roll for the secondary transfer roll 71.

The attachment plate 103 is provided with two positioning recesses 103*a* (see FIG. 5) for positioning two rotary bearings 712 (only one of which is shown) which are positioning members for the secondary transfer roll 71, respectively.

The fixing device 8 which has a heating roll 80 and a pressure roll 81 is disposed between the secondary transfer roll 71 and two discharge rolls 130 and is provided in the accommodation space 100*b*.

The exposing device 9 forms an electrostatic latent image on each photoreceptor drum 20 by exposing each photoreceptor drum 20 to a laser beam that is modulated according to image data of the corresponding color (Y, M, C, or K) and applied via mirrors (not shown).

(Configuration of Sheet Supply Unit 12)

The sheet supply unit 12 is provided with a sheet supply tray 121 in which sheets P are stacked, a pickup roll 122 for sending out top ones of the sheets P stacked in the sheet supply tray 121, and two retard rolls 123 for separating the sheets P sent from the pickup roll 122 into individual sheets P. The sheet supply unit 12 is disposed below the image forming unit 11 and provided in the accommodation space 100*b*.

Two registration rolls 124 which are driven in synchronism with image forming operations of the image forming units 2Y, 2M, 2C, and 2K and two conveying rolls 125 for conveying a sheet P from the registration rolls 124 toward the image forming unit 11 are disposed downstream of the retard rolls 123.

(Configuration of Sheet Discharge Unit 13)

The sheet discharge unit 13 has the two discharge rolls 130 and is disposed adjacent to the outputted sheet tray 10*a*.

The discharge rolls 130 are supported rotatably in the apparatus main body 10. The discharge rolls 130 are configured so as to discharge, to the outside, a sheet P on which an image has been formed by the image forming unit 11 as they rotate in predetermined directions.

(Configuration of Second Transfer Device 7)

Figure 2:
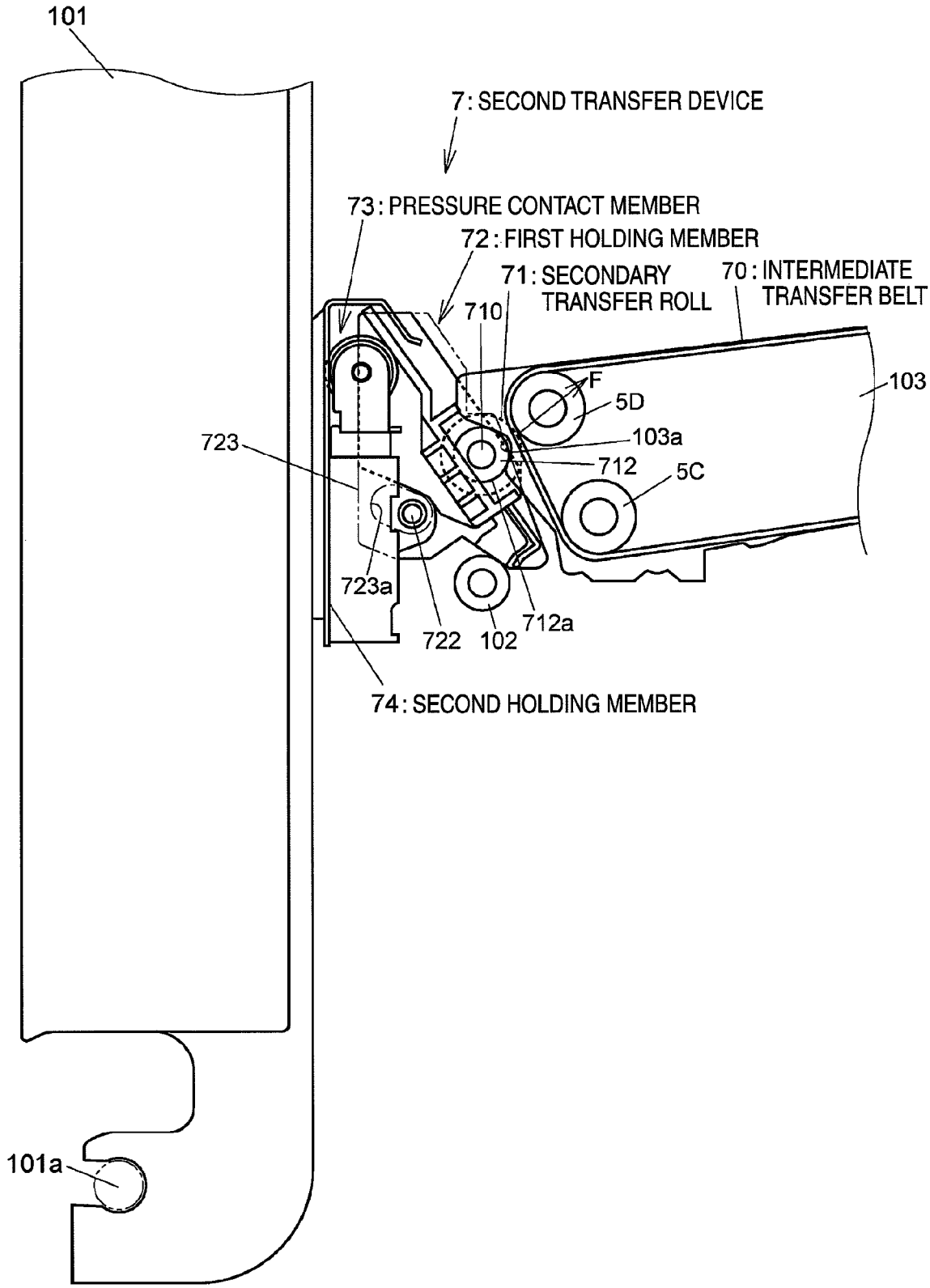
FIG. 2 is a side view of the transfer device according to the exemplary embodiment of the invention.
Figure 3:
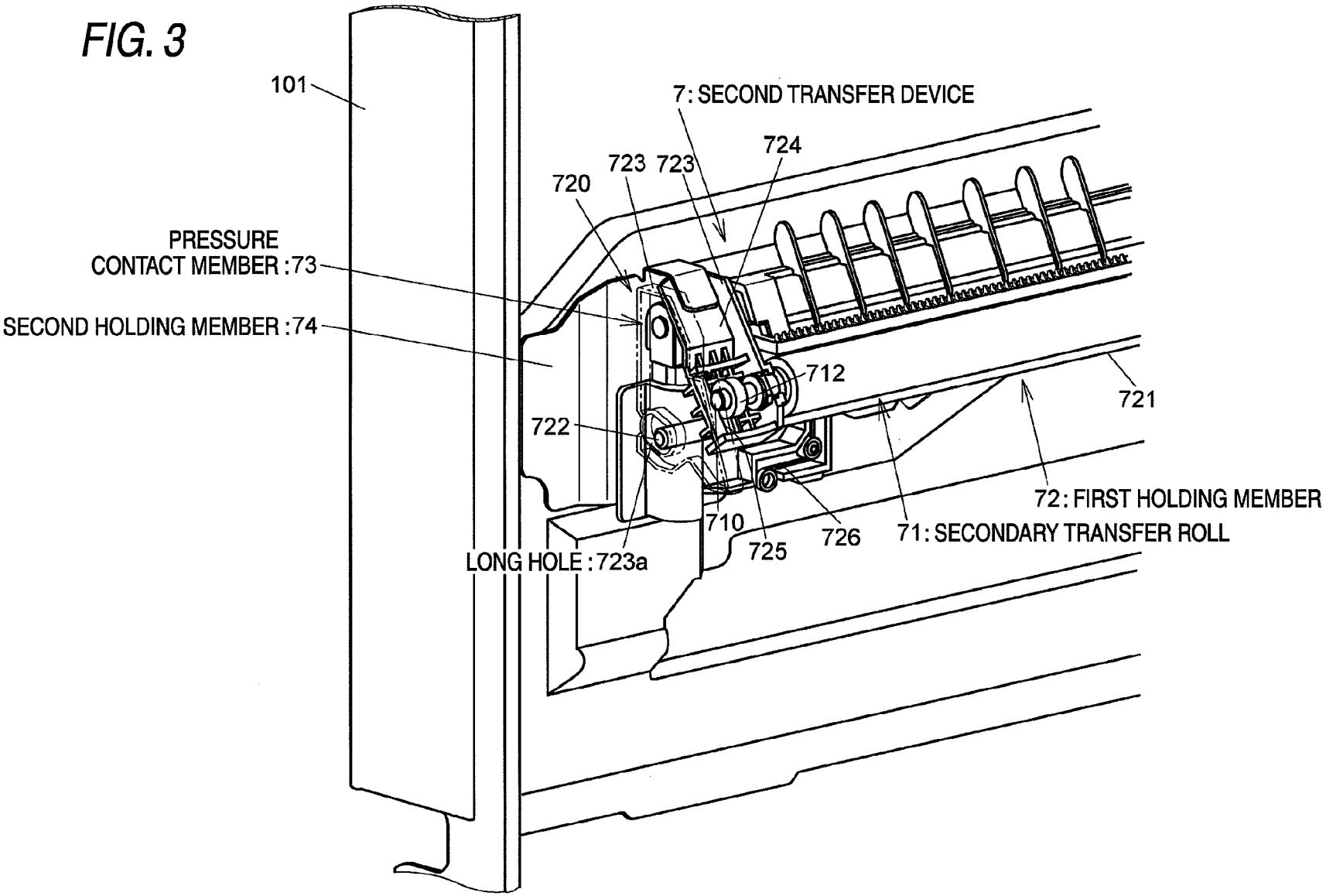
FIG. 3 is a perspective view, as viewed from above, of the transfer device according to the exemplary embodiment of the invention.
Figure 4:
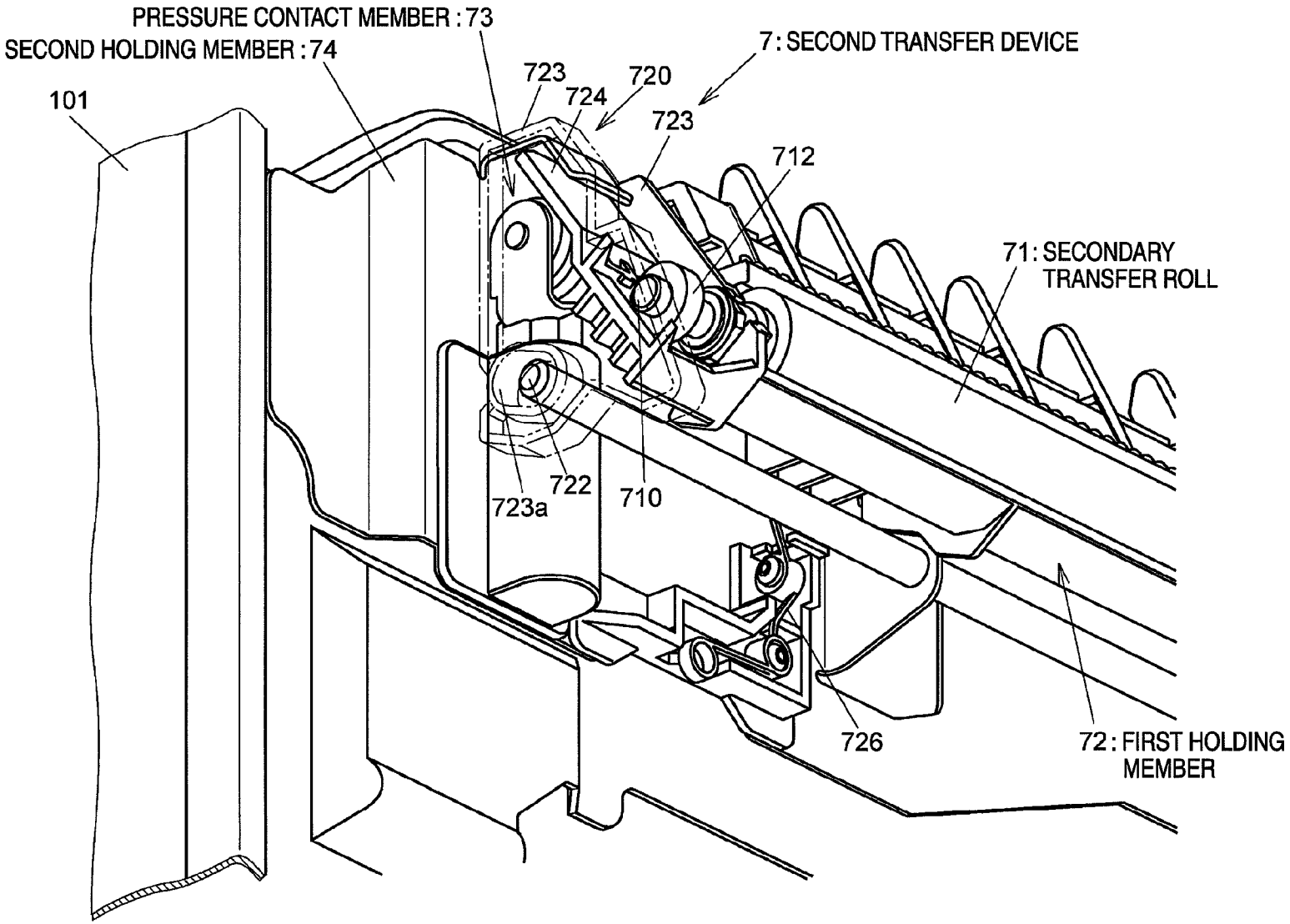
FIG. 4 is a perspective view, as viewed from below, of the transfer device according to the exemplary embodiment of the invention.
Figure 5:
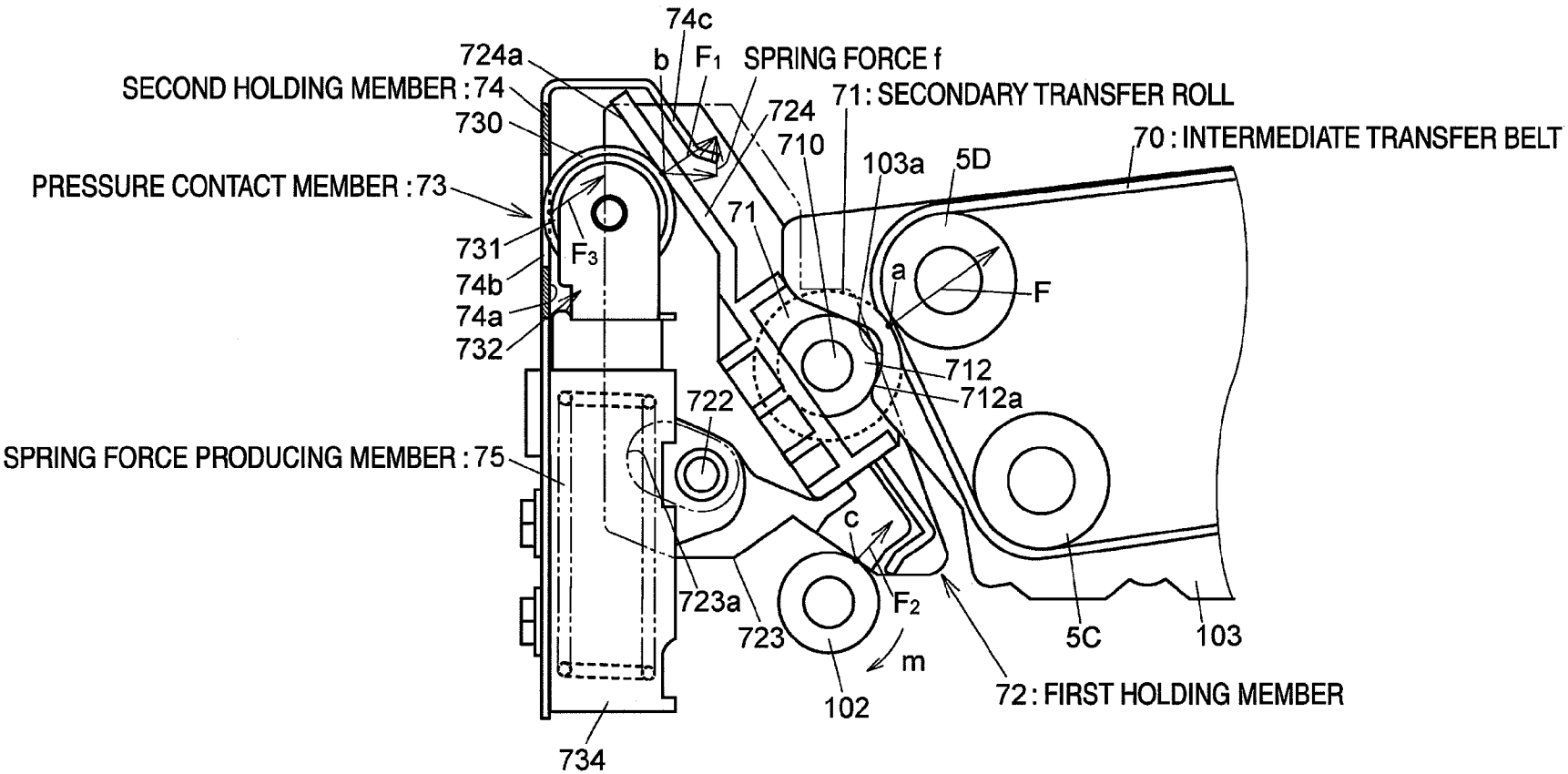
FIG. 5 is a side view showing an important part of the transfer device according to the exemplary embodiment of the invention.
Figure 6:
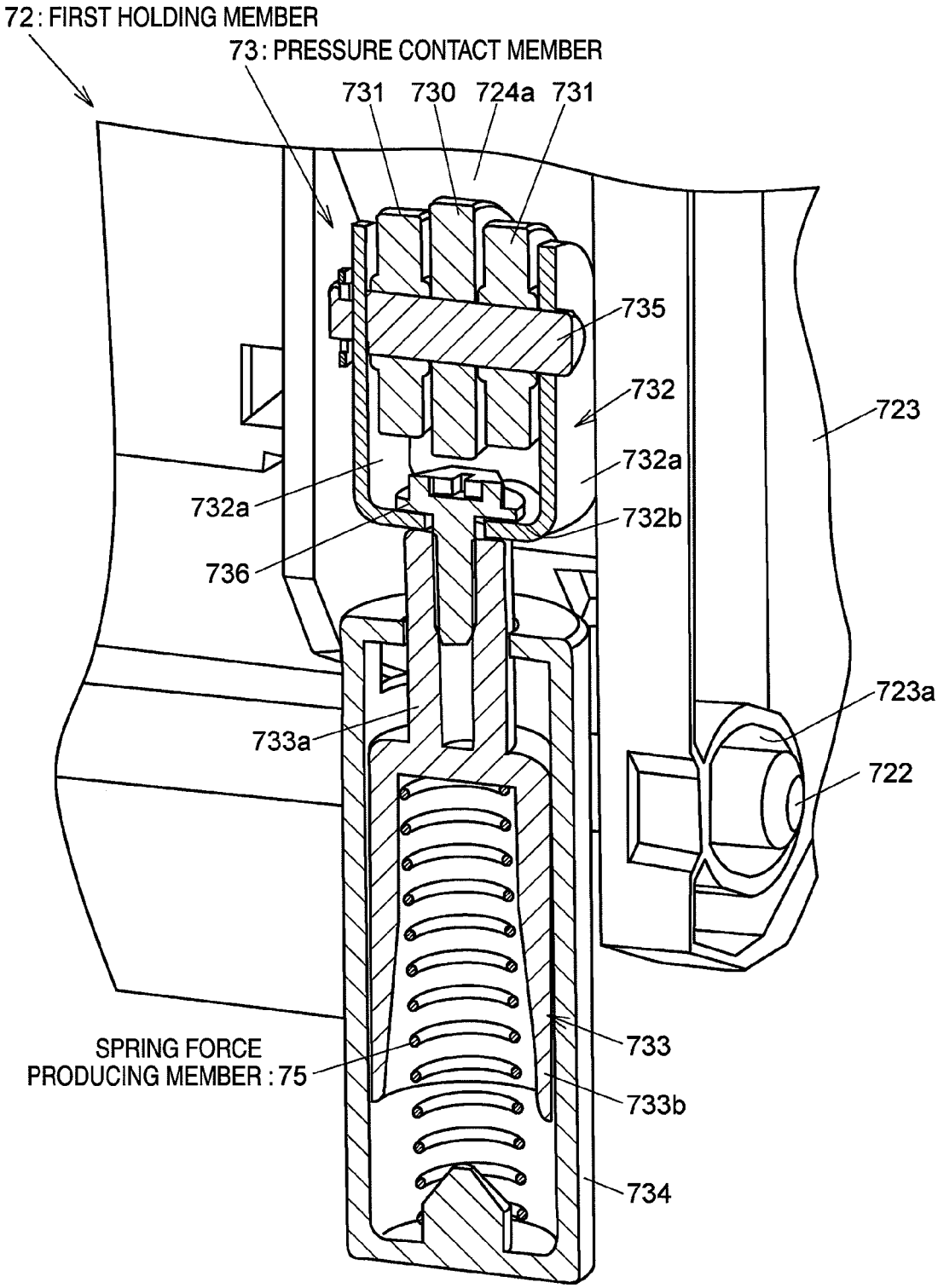
FIG. 6 is a partially sectional view showing a pressure contact member and a spring force producing member.

Next, the second transfer device 7 according to the exemplary embodiment of the invention will be described with reference to FIGS. 2-6. FIG. 2 is a side view of the second transfer device 7. FIG. 3 is a perspective view, as viewed from above, of the second transfer device 7. FIG. 4 is a perspective view, as viewed from below, of the second transfer device 7. FIG. 5 is an enlarged view of part of FIG. 2. FIG. 6 shows a pressure contact member and a spring force producing member.

As shown in FIGS. 2-4, the second transfer device 7 is generally composed of the intermediate transfer belt 70 for bearing toner images transferred to it from the photoreceptor drums 20 (see FIG. 1), the secondary transfer roll 71 for secondarily transfers the toner images from the intermediate transfer belt 70 to a sheet P (see FIG. 1), the first holding member 72 for holding the secondary transfer roll 71 rotatably, two pressure contact members 73 for bringing, via the first holding member 72, the secondary transfer roll 71 into pressure contact with the intermediate transfer belt 70, a second holding member 74 for holding the first holding member 72 swingably and movably, and two spring force producing members 75 for producing spring forces f (see FIG. 5) for bringing the pressure contact members 73 into pressure contact with the second holding member 74 and the first holding member 72.

(Configuration of Intermediate Transfer Belt 70)

As shown in FIG. 2, the intermediate transfer belt 70 is disposed between the first transfer devices 3Y, 3M, 3C, and 3K (see FIG. 1) and the respective photoreceptor drums 20 (see FIG. 1) and wound on the support rolls 5A-5D (only the support rolls 5C and 5D are shown in FIG. 2). The second transfer device 7 is configured so that the intermediate transfer belt 70 receives a pressure contact force F (about 80 to 90 N) from the first holding member 71 via the secondary transfer roll 71 in the state that the lid member 101 is closed.

(Configuration of Secondary Transfer Roll 71)

As shown in FIG. 2, the secondary transfer roll 71 has a roll shaft 710. The secondary transfer roll 71 is disposed at such a position that its roll surface is opposed to the roll surface of the support roll 5D with the intermediate transfer belt 70 interposed in between, and the secondary transfer roll 71 is held rotatably by the first holding member 72 via the two rotary bearings 712 (only one of which is shown) of the roll shaft 710. The secondary transfer roll 71 is configured so as to rotate when the intermediate transfer belt 70 is driven in the state that the lid member 101 is closed.

The rotary bearings 712 (only one of which is shown) having roll surfaces 712*a* (only one of which is shown) which are opposed to the inner surfaces of the positioning recesses 103*a* are fixed to the two ends of the roll shaft 710, respectively.

(Configuration of First Holding Member 72)

As shown in FIG. 3, the first holding member 72 is composed of two holding members 720 (only one of which is shown) which are opposed to each other with the secondary transfer roll 71 disposed in between and a link member 721 which connects the two holding members 720. The first holding member 72 is held swingably and movably by the second holding member 74 via a support shaft 722.

Each holding member 720 is composed of two side walls 723 which are opposed to each other and a middle wall 724 which is interposed between the two side walls 723. The holding members 720 are disposed at the two respective side ends of the first holding member 72.

Of the two side walls 723, the outside side wall 723 is formed with a long hole 723*a* that allows the support shaft 722 to escape when the first holding member 72 is moved.

As shown in FIGS. 4 and 5, the middle wall 724 is provided with a pressure contact force receiving surface 724*a* for receiving a pressure contact force $F_1$ which is part of a pressure contact force F (which is a resultant force of the pressure contact forces $F_1$ and $F_2$) for bringing the secondary transfer roll 71 into pressure contact with the intermediate transfer belt 70. The pressure contact force receiving surface 724*a* is a slant surface which is inclined by about 35° from a rolling receiving surface 74*a* of the second holding member 74 in the state that the lid member 101 is closed. The middle wall 724 is provided with a leaf spring 725 (see FIG. 3) on which the secondary transfer roll 71 is placed via the rotary bearing 712.

On the other hand, the link member 721 occupies a central portion of the first holding member 72 and is integral with the two holding members 720. A torsion spring 726 for exerting a spring force on the first holding member 72 in such a direction as to bring the inner surface of the long hole 723*a* into pressure contact with the outer circumferential surface of the support shaft 722 is provided between the link member 721 and the second holding member 74.

(Configuration of Pressure Contact Member 73)

As shown in FIGS. 5 and 6, each pressure contact member 73 is provided with a first roll 730 which can come into contact with and roll on the pressure contact force receiving surface 724*a* of the middle wall 724, two second rolls 731 which can come into contact with and roll on the rolling receiving surface 74*a* of the second holding member 74, a roll holder 732 which holds the rolls 730 and 731, and a spring receiver 733 for receiving the spring force of the spring force producing member 75. The pressure contact member 73 is held in a reciprocable manner by the second holding member 74 via a holder case 734. The pressure contact member 73 is moved between a bottom position (destination position) and a top position (return position) which correspond to the closed state and the open state of the lid member 101, respectively. The first roll 730 is configured so as to exert the pressure contact force $F_1$ on the first holding member 72 at position b that is on one side of the pressure contact point a, that is, on the side opposite to the swing restriction member 102.

The first roll 730 is held rotatably by the roll holder 732 via a support shaft 735. The first roll 730 is configured so as to rotate counterclockwise (as viewed in FIG. 5) as the pressure contact member 73 goes in such a direction that the spring force producing member 75 is compressed when the lid member 101 is closed, and to rotate clockwise (as viewed in FIG. 5) as the pressure contact member 73 returns in such a direction that the spring force producing member 75 is expanded when the lid member 101 is opened. The outer diameter of the first roll 730 is set larger than that of the second rolls 731, as a result of which the second rolls 731 do not contact the pressure contact force receiving surface 724*a*.

The second rolls 731, which are two rolls that are arranged side by side with the first roll 730 disposed in between, are held by the roll holder 732 so as to be rotatable about the support shaft 735. The second rolls 731 are configured so as to rotate clockwise (as viewed in FIG. 5) as the pressure contact member 73 goes in such a direction that the spring force producing member 75 is compressed when the lid member 101 is closed, and to rotate counterclockwise (as viewed in FIG. 5) as the pressure contact member 73 returns in such a direction that the spring force producing member 75 is expanded when the lid member 101 is opened.

The roll holder 732 is composed of two side plates 732*a* which are opposed to each other and a link portion 732*b* which connects the side plates 732*a*, and is attached to the spring receiver 733 with a screw 736.

The spring receiver 733 is composed of a small-diameter cylinder 733*a* with which the screw 736 is engaged and a large-diameter cylinder 733*b* which houses the spring force producing member 75. Most of the spring receiver 733 is disposed inside the holder case 734 (i.e., part of the spring receiver 733 is exposed from the holder case 734). The small-diameter cylinder 733*a* is inserted in a top wall of the holder case 734 and is integral with the large-diameter cylinder 733*b*, and is, as a whole, a cylindrical member that is open at both ends in the its axial direction. On the other hand, the large-diameter cylinder 733*b* is housed in the holder case 734 and is, as a whole, a cylindrical member that is open on the side opposite to the small-diameter cylinder 733*a* (closed on the other side).

(Configuration of Second Holding Member 74)

As shown in FIG. 5, the second holding member 74 has the rolling receiving surface 74*a* for receiving force from the second roller 731 in contact and is attached to the lid member 101 (see FIG. 4). The second holding member 74 is configured so as to bring the secondary transfer roll 71 into pressure contact with the intermediate transfer belt 70 with a pressure contact force $F_3$ (about 25 to 35 N) via the first rolls 730 and the first holding member 72 in the state that the lid member 101 is closed. The pressure contact force $F_3$, which is part of the pressure contact force $F_1$, is exerted on the first holding member 72 from the first rolls 730 at position b. The second holding member 74 is formed with insertion windows 74*b* in which the respective first rolls 730 are inserted. As a result, the first rolls 730 do not contact the rolling receiving surface 74*a*. Two swing restriction pieces 74*c* for restricting a swing of the first holding member 72 in the direction indicated by arrow m are integral with the second holding member 74.

(Configuration of Spring Force Producing Member 75)

As shown in FIGS. 5 and 6, the spring force producing member 75, which is a compression coil spring capable of expansion and contraction in its axial direction, is housed in the holder case 734 and is placed between the bottom surface of the top wall of the large-diameter cylinder 733*b* and the top surface of the bottom wall of the holder case 734. The spring force producing member 75 is configured so as to produce a spring force f (about 20 to 30 N; part of the pressure contact force $F_1$ ($F_1$>f)) for bringing the pressure contact member 73 into pressure contact with the first holding member 72 and the second holding member 74 in the state that the pressure contact force receiving surface 724*a* of each middle wall 724 is inclined from the second holding member 74, that is, the lid member 101 is closed.

Since as described above the pressure contact force $F_1$ acts on the first holding member 72, the first holding member 72 receives moment with the pressure contact point a as the supporting point. However, as shown in FIG. 5, the swing restriction member 102 which is provided below and comes into contact with the first holding member 72 exerts a pressure contact force $F_2$ (reaction force corresponding to the moment) on the first holding member 72 at position c.

As a result, the pressure contact force F to act on the intermediate transfer belt 70 is exerted on the secondary transfer roll 71 as a resultant force of the pressure contact forces $F_1$ and $F_2$. In the exemplary embodiment, the pressure contact force F is about 80 to 90 N. On the other hand, the spring force f for bringing the pressure contact members 73 into pressure contact with the first holding member 72 and the second holding member 74 is 20 to 30 N. That is, assuming that springs that provide the same spring force are used, the configuration of the exemplary embodiment can produce a higher nip load than a configuration in which the secondary transfer roll 71 is brought into pressure contact with the intermediate transfer belt 70 directly by a spring force. The term "nip load" means a pressure contact force that brings the secondary transfer roll 71 into pressure contact with the intermediate transfer belt 70. Since the pressure contact force F acts on the first holding member 72 in a distributed manner at positions b and c, the nip load can be obtained stably at the pressure contact point a.

In the exemplary embodiment, the distance between the pressure contact point a and position b is longer than the distance between the pressure contact point a and position c. Therefore, in the state that the lid member 71 is closed and the moments around the pressure contact point a (supporting point) are balanced, the pressure contact forces $F_1$ and $F_2$ have a relationship $F_1<F_2$. Since $F_1>f$, f is weaker than $F_2$. The spring force f is a reaction force corresponding to force of closing the lid member 101. By virtue of the above configuration, the spring force f of the springs for producing the pressure contact force F can be made weaker and hence the manipulation force for closing the lid member 101 can be reduced.

(Operation of Image Forming Apparatus 1)

Next, the operation of the image forming apparatus 1 according to the exemplary embodiment will be described with reference to FIG. 1.

As shown in FIG. 1, sheets P are picked up from the sheet supply tray 121 by the pickup roll 122 and separated into individual sheets P by the retard rolls 123. And a sheet P is sent from the retard rolls 123 to the registration rolls 124.

Then, the head of the sheet P is caused to hit the registration rolls 124, whereby a skew of the sheet P is corrected and its head is registered. The sheet P stands by there.

Then, the registration rolls 124 are rotated in synchronism with an image forming operation of the image forming apparatus 11, whereby the sheet P is supplied to the secondary transfer roll 71. After toner images are transferred primarily to the intermediate transfer belt 70 by the first transfer devices 3Y, 3M, 3C, and 3K, the toner images are transferred secondarily to the sheet P at the position of the secondary transfer roll 71 in the second transfer device 7. Then, the toner images are fixed onto the sheet P in the fixing device 8 and the sheet P is conveyed from the fixing device 8 to the sheet discharge unit 13.

Subsequently, the sheet discharge unit 13 discharges the sheet P to the outputted sheet tray 10*a* as the discharge rolls 130 rotate.

An operation for removing a sheet P jammed in the second transfer device 7 to outside the apparatus main body 10 will be described below with reference to FIGS. 7A and 7B, which show states that the lid member 101 is closed and opened, respectively.

Figure 7A:
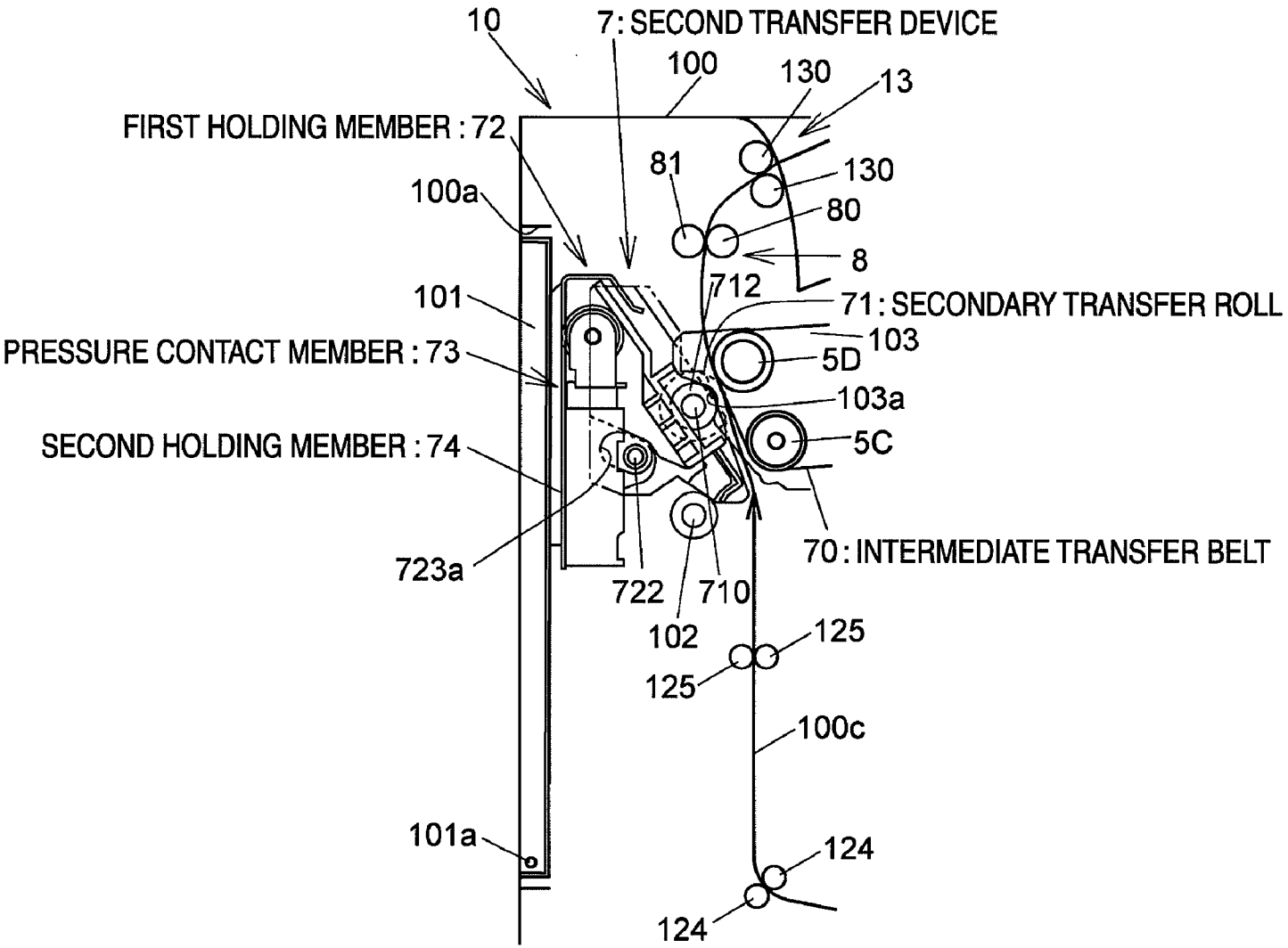
FIGS. 7A and 7B are sectional views for description of an operation of the image forming apparatus to which the transfer device according to the exemplary embodiment of the present invention is applied.
Figure 7B:
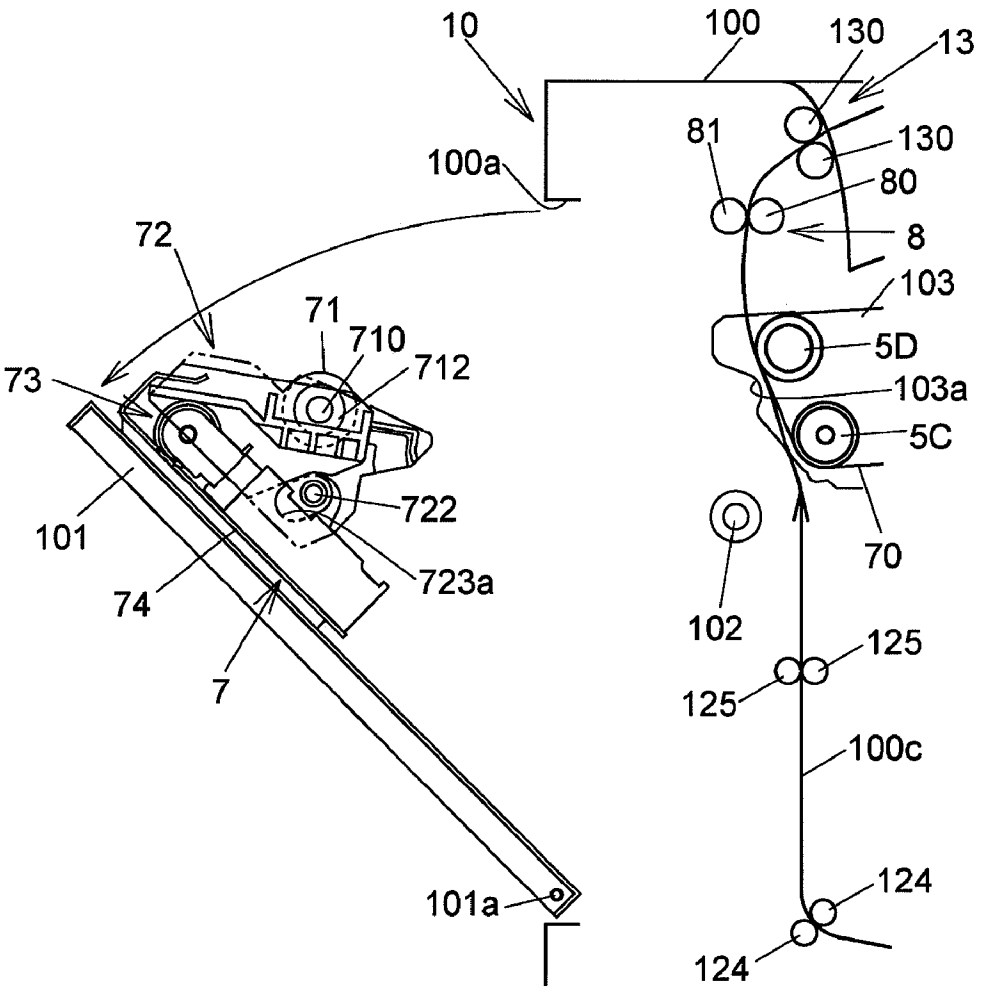

If, for example, a sheet P is jammed when it is nipped between the intermediate transfer belt 70 and the secondary transfer roll 71 in the apparatus main body 10, a manipulation of swinging the lid member 101 in the opening direction is performed, whereby a change is made from the closed state of FIG. 7A to the open state of FIG. 7B. When the lid member 101 is in the open state, the second holding member 74 is located at a swing end position. During the course of establishing that state, the second holding member 74 is rotated about a swing center 101*a* while the support shaft 722 escapes in the longitudinal directions of the long holes 723*a*. Since the swing restriction pieces 74*c* come into contact with the first holding member 72, a pressure contact force $F_1$ acts on the swing restriction pieces 74*c*. As a result, the loads that are exerted at positions a and c via the middle walls 724 because of the pressure contact force $F_1$ become lower and the pressure contact forces F and $F_2$ are reduced. After the support shaft 722 comes into contact with the side surfaces of the long holes 723*a*, the first holding member 72 is swung about the swing center 101*a* following the swing of the second holding member 74. Then, the positioning rolls 712 are swung together with the first holding member 72 and the state that the positioning rolls 712 are positioned with respect to the positioning recesses 103*a* is canceled and the state that the swing of the first holding member 72 is restricted by the swing restriction member 102 is also canceled. Furthermore, when the secondary transfer roll 71 is separated from the intermediate transfer belt 70 (i.e., the state that the secondary transfer roll 71 is in pressure contact with the intermediate transfer belt 70 is canceled), the first holding member 72 is moved smoothly because the pressure contact forces F and $F_2$ have been reduced. The sense of manipulation of the lid member 101 is thus improved.

Subsequently, the sheet P (see FIG. 1) existing in the region between the secondary transfer roll 71 and the intermediate transfer belt 70 in the apparatus main body 10 is removed to outside the apparatus main body 10 through the opening 100*a*.

After the sheet jam has been solved, a change is made from the open state of FIG. 7B to the closed state of FIG. 7A by swinging the lid member 101 in the closing direction. When the lid member 101 is in the closed state, the second holding member 74 is located at a swing start position. During the course of establishing that state, the first holding member 72 is swung following a swing of the second holding member 74 in such a direction that the secondary transfer roll 71 is brought closer to the intermediate transfer belt 70 while the support shaft 722 escapes in the longitudinal directions of the long holes 723*a*. Since the swing restriction pieces 74*c* are in contact with the first holding member 72, a pressure contact force $F_1$ acts on the swing restriction pieces 74*c*. As a result, the loads that are exerted at positions a and c become lower. Therefore, almost no pressure contact force F is produced when the rotary bearings 712 are swung together with the first holding member 72 and positioned by the positioning recesses 103*a* and the swing of the first holding member 72 comes to be restricted by the swing restriction member 102. Then, when in the second holding member 74 the support shaft 722 is moved along the long holes 723*a* and the lid member 101 is closed, the first holding member 72 is separated from the swing restriction members 74*c*. As a result, the secondary transfer roll 71 receives the pressure contact force F (see FIG. 5) from the first holding member 72 and is brought into pressure contact with the intermediate transfer belt 70. At this time, the secondary transfer roll 71 receives the pressure contact force $F_1$ (see FIG. 5) from the pressure contact member 73 via the first holding member 72 and receives the pressure contact force $F_2$ (see FIG. 5) from the swing restriction member 102 via the first holding member 72 and exert them to the intermediate transfer belt 70.

Although the transfer device and the image forming apparatus according to the exemplary embodiment of the invention have been described above, the invention is not limited to the above exemplary embodiment and various modifications are possible without departing from the spirit and scope of the invention. For example, the following modifications are possible.

(1) In the exemplary embodiment, the first holding member 72 receives the pressure contact forces $F_1$ and $F_2$ at positions b and c, respectively, and the secondary transfer roll 71 is brought into pressure contact with the intermediate transfer belt 70 by those pressure contact forces $F_1$ and $F_2$. However, the invention is not limited to such a case. A modification is possible in which the first holding member receives a pressure contact force at the position where the secondary transfer roll is brought into pressure contact with the intermediate transfer belt and the secondary transfer roll is brought into pressure contact with the intermediate transfer belt by that pressure contact force. That is, in short, it suffices that the invention is provided with the spring force producing member which produces a spring force for bringing the pressure contact member into pressure contact with the first holding member and the second holding member in a state that the first holding member is inclined from the second holding member. This feature makes it possible to attain the object of producing a necessary nip load by a weaker spring force than in a case that a spring force is generated in the direction of a pressure contact force that acts from the secondary transfer roll to the intermediate transfer belt.

(2) Although the exemplary embodiment is directed to the copier, the invention is not limited to such a case and can be applied to a printer, a facsimile machine, or a multifunction machine which is a combination of at least two of a printer, a facsimile machine, etc.

(3) Although in the exemplary embodiment the image forming apparatus 1 is the color image forming apparatus having the plural photoreceptor drums 20, the invention is not limited to such a case and can be applied to a monochrome image forming apparatus having a single photoreceptor drum.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A transfer device comprising:

a transfer roll that transfers a toner image formed on an image holding body to a transfer subject medium;

a first holding member that holds the transfer roll rotatably;

a pressure contact member that is configured to push the first holding member to move the transfer roll into pressure contact with the image holding body;

a second holding member that holds the pressure contact member rotatably; and a pressing member that produces a pressing force for bringing the pressure contact member into pressure contact with the first holding member.

2. The transfer device according to claim 1, wherein the pressure contact member exerts a first pressure contact force on the first holding member at a position that is distant from a supporting point to one side, wherein the supporting point is a pressure contact portion where a pressure contact force acts from the transfer roll to the image holding body.

3. The transfer device according to claim 2, wherein the first holding member receives a second pressure contact force, that is not the first pressure contact force, at a position that is distant from the supporting point to an other side than the one side.

4. The transfer device according to claim 3, wherein a distance between the supporting point and the position that is distant from the supporting point to the one side is longer than a distance between the supporting point and the position that is distant from the supporting point to the other side.

5. An image forming apparatus comprising:

the transfer device according to claim 2; and an image forming unit that forms an image on a sheet.

6. The image forming apparatus according to claim 5, which further comprises: an apparatus main body comprising a case member having an opening and a lid member that opens and closes the opening, the apparatus main body housing the image forming unit and the transfer device.

7. An image forming apparatus comprising:

the transfer device according to claim 1; and an image forming unit that forms an image on a sheet.

8. The image forming apparatus according to claim 7, which further comprises: an apparatus main body comprising a case member having an opening and a lid member that opens and closes the opening, the apparatus main body housing the image forming unit and the transfer device.

9. The image forming apparatus according to claim 8, wherein in the transfer device the first holding member is held swingably and movably by the second holding member via a support shaft, and wherein in the apparatus main body the lid member is integral with the second holding member.

10. The image forming apparatus according to claim 8, wherein in the transfer device, the pressure contact member comprises a first roll configured to roll on the first holding member and a second roll configured to roll on the second holding member.

11. The image forming apparatus according to claim 8, wherein in the transfer device, the first holding member contains a long hole.

12. The image forming apparatus according to claim 8, wherein the apparatus main body further comprises, inside, a swing restriction member that restricts a swing amount of the first holding member and exerts a pressure contact force on the first holding member.

13. The image forming apparatus according to claim 7, wherein the pressure contact member is configured to roll along an outer surface of the first holding member.

14. The image forming apparatus according to claim 13, wherein the pressure contact member is configured to roll along a surface of the second holding member and the outer surface of the first holding member is inclined with respect to the surface of the second holding member.

15. The image forming apparatus according to claim 7, wherein the pressing member pushes the pressure contact member in a direction inclined with respect to an outer surface of the holding member contacted by the pressure contact member.

16. The transfer device according to claim 1, wherein the pressure contact member is configured to roll along an outer surface of the first holding member.

17. The transfer device according to claim 16, wherein the pressure contact member is configured to roll along a surface of the second holding member and the outer surface of the first holding member is inclined with respect to the surface of the second holding member.

18. The transfer device according to claim 1, wherein the pressing member pushes the pressure contact member in a direction inclined with respect to an outer surface of the holding member contacted by the pressure contact member.

* * * * *